US007233680B2

(12) United States Patent
Kobayashi et al.

(10) Patent No.: US 7,233,680 B2
(45) Date of Patent: Jun. 19, 2007

(54) SPEAKER DEVICE

(75) Inventors: Shinji Kobayashi, Chiba (JP); Haruto Kusunoki, Kanagawa (JP)

(73) Assignee: Sony Corporation, Tokyo (JP)

( * ) Notice: Subject to any disclaimer, the term of this patent is extended or adjusted under 35 U.S.C. 154(b) by 279 days.

(21) Appl. No.: 10/990,889

(22) Filed: Nov. 17, 2004

(65) Prior Publication Data

US 2005/0105756 A1 May 19, 2005

(30) Foreign Application Priority Data

Nov. 17, 2003 (JP) ..... 2003-387144

(51) Int. Cl.
*H04R 25/00* (2006.01)

(52) U.S. Cl. ..... 381/396; 381/389; 381/409

(58) Field of Classification Search ..... 381/394, 381/189, 409, 86, 396, 398, 389, 395
See application file for complete search history.

(56) References Cited

U.S. PATENT DOCUMENTS

| | | | | |
|---|---|---|---|---|
| 4,661,973 | A | 4/1987 | Takahashi | |
| 5,062,140 | A | 10/1991 | Inanaga et al. | |
| 5,402,503 | A | 3/1995 | Prokisch | |
| 5,461,677 | A | 10/1995 | Raj et al. | |
| 6,269,168 | B1 | 7/2001 | Tagami | |
| 6,574,346 | B1 | 6/2003 | Tanaka | |
| 6,675,931 | B2 * | 1/2004 | Sahyoun | 181/157 |
| 2004/0003959 | A1 | 1/2004 | Koizumi et al. | |
| 2005/0123154 | A1 | 6/2005 | Kobayashi et al. | |
| 2005/0129266 | A1 | 6/2005 | Kobayashi et al. | |

FOREIGN PATENT DOCUMENTS

| | | |
|---|---|---|
| EP | 0581129 A1 | 2/1994 |
| JP | 58-34484 | 3/1983 |
| JP | 59062299 A | 4/1984 |
| JP | 03083496 | 4/1991 |
| JP | 7-222282 | 8/1995 |
| JP | 7-274285 | 10/1995 |

* cited by examiner

*Primary Examiner*—Curtis Kuntz
*Assistant Examiner*—Tuan Duc Nguyen
(74) *Attorney, Agent, or Firm*—Wolf, Greenfield & Sacks, P.C.

(57) ABSTRACT

To realizes a speaker device with a simple construction capable of keeping stable statement, regardless of vehicle types. A speaker device for applying electromagnetic force to a voice coil based on a supplied audio signal and generating a sound wave based on the audio signal by vibrating a vibratory plate fixed to the voice coil is provided with: a frame with one end supporting the vibratory plate and the other supporting an electromagnetic force generation means for applying the electromagnetic force to the voice coil; a first connector provided at the one end of the frame and having an input terminal for the audio signal; a first wire drawn from the first connector and connected so as to be conducted to the voice coil via the vibratory plate; a second connector provided at the other end of the frame and having an input terminal for the audio signal; and a second wire drawn from the second connector and connected so as to be conducted to the voice coil.

2 Claims, 5 Drawing Sheets

30

SPEAKER DEVICE

BACKGROUND OF THE INVENTION

1. Field of the Invention

This invention relates to a speaker device and is suitably applied to an audio system which is installed in a vehicle, for example.

2. Description of the Related Art

As audio systems to be installed in vehicles, such systems has been popularized that a plurality of speakers are arranged not only at the front and rear cabinets of a vehicle but also at places surrounding a driver, including the inside of doors, so that the listening driver can feel of "being there".

Out of these speakers, speakers to be installed at the doors are attached so that its vibratory plate side (hereinafter, referred to as a dry side) faces the inside of the vehicle and its magnetic circuit side (hereinafter, referred to as wet side) faces the outside of the vehicle.

Normally, because rain or car wash water enter from gaps of glass windows, the outsides of vehicle doors are provided with various waterproof functions. Considering that water enters when the windows are opened and closed, a surface facing the wet side of a speaker to be installed is covered with a rain cover.

Conventionally, as cone speakers to be installed on doors of this type, cone speakers (hereinafter, referred to as wet speakers) in which a lead line drawn from a voice coil is wired so as to be contained on the wet side are mainly used. Recently, however, such speakers (hereinafter, referred to as dry speakers) that a lead line drawn from a voice coil is wired so as to be drawn to the dry side via a coil vibratory plate are also used in many cases.

That is, as shown in FIG. 1, the wet speaker 1 has a conic cone vibratory plate 2 with its end opened. The outer circumference of the cone vibratory plate 2 is supported via a gasket 5 by an edge 4 formed on a frame 3. The opening of its inner circumference is supported by a damper 6 attached to the frame 3, so as to be movable forwards and backwards to the frame 3.

The bottom of the opening of the cone vibratory plate 2 is fixed to a cylindrical voice coil bobbin 8 having wounded thereon a voice coil 7 comprising a lead line. Above the opening, a hemisphere head cap 9 is attached with its projecting side facing outwards so as to cover the opening, thereby preventing deformation of the cone vibratory plate 2 in the radial direction and preventing dusts from entering inside.

In addition, to the bottom of the frame 3, a magnetic circuit 10 to vibrate the cone vibratory plate 2 forwards and backwards is fixed. This magnetic circuit 10 is composed of a disk yoke 11 with a column pole piece 11A placed at the center, on the top surface, a toric magnet 12 surrounding the outer circumference of the yoke 11, and a toric plate 13 laminated and fixed on the magnet 12.

The magnetic circuit 10 is attached to the frame 3 so that the top surface of the plate 13 is fixed to the bottom of the frame 3, and the voice coil bobbin 8 having the voice coil 7 wounded thereon is held in a contactless manner in a magnetic gap g formed between the pole piece 11A and the plate 13.

Therefore, in the wet speaker 1, when electromagnetic force is applied to the voice coil 7 according to applied current based on an audio signal externally supplied, the voice coil 7 and the magnet 12 attract or repel each other, thereby generating a sound wave according to the audio signal by vibrating the cone vibratory plate 2 forwards and backwards.

In this wet speaker 1, a connector (hereinafter, referred to as wet side connector) 14 having a plurality of connecting terminals provided thereon is provided on a projecting part 3P projecting from the outer circumference on the bottom of the frame 3. In addition, wires drawn from playback devices (not shown) such as external Mini Disc (MD) players and tuners are connected to the connecting terminals.

In this wet side connector 14, a harness 15 is drawn from each connecting terminal and the harnesses 15 are connected so as to be conducted to the lead line 7A of the voice coil 7.

In FIG. 2 where the same reference numerals are applied to parts corresponding to those of FIG. 1, the dry speaker 20 is identical to the above-described wet speaker 1 (FIG. 1), excepting for the shape of a frame 21 and the drawing state of a lead line 7A of a voice coil 7.

In this dry speaker 20, a connector (hereinafter, referred to as a dry side connector) 22 with a plurality of connecting terminals is provided on a projecting part 21P projecting from the outer circumference of the top of the frame 21. And wires drawn from playback devices (not shown) such as external MD players and tuners are connected to the connecting terminals.

In this dry side connector 22, a harness 23 is drawn from each connecting terminal and the harnesses 23 are connected so as to be conducted to the lead line 7A of the voice coil 7 through a prescribed part 2H of the cone vibratory plate 2 (Refer to Japanese Patent Laid-Open No. 7-274285).

By the way, although many genuine cone speakers to be installed in manufacturing stage of vehicles are wet speakers, various makers mainly produce dry speakers as cone speakers.

Therefore, in a case where the user replaces a wet speaker installed in a door of his/her vehicle, with a desired dry speaker, he/she has to change connection of harnesses conducted to the lead line of the voice coil from the wet side to the dry side. This work is very troublesome for the user and a worker, and becomes a problem.

In addition, in a case where the connection of the harnesses conducted to the lead line of the voice coil is changed to the dry side via the wet side connector, the wet side connector contacts the rain cover. This makes the attachment of the speaker difficult and generates rust due to beading. In addition, if the user forcedly changes the connection of the harnesses, the speaker may be easy to come off.

SUMMARY OF THE INVENTION

This invention has been made in view of foregoing and intends to propose a speaker device with a simple construction capable of realizing stable attachment regardless of vehicle types.

To solve the above problems, this invention provides a speaker device for applying electromagnetic force to a voice coil based on a supplied audio signal and generating a sound wave based on the audio signal by vibrating a vibratory plate fixed to the voice coil. This speaker device comprises: a frame with one end supporting the vibratory plate and the other end supporting an electromagnetic force generation means for applying the electromagnetic force to the voice coil; a first connector provided at the one end of the frame and having an input terminal for the audio signal; a first wire drawn from the first connector and connected so as to be conducted to the voice coil via the vibratory plate; a second connector provided at the other end of the frame and having an input terminal for the audio signal; and a second wire drawn from the second connector and connected so as to be conducted to the voice coil.

As a result, when this speaker device is attached to the inside of a vehicle door, one of the first and second connectors can be used as it is, depending on the internal arrangement of the door.

In addition, in this invention, the first connector is designed to form part of an outer circumference on the one end of the frame. As a result, this speaker device can be prevented from contacting parts inside the door when attached to the inside of the door. Therefore, versatility can be expanded because the attachment of the speaker device is not affected by the internal shape of the door, thus making it possible to realize a speaker device with a simple construction capable of keeping stable attachment state regardless of vehicle types.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Preferred embodiments of this invention will be described with reference to the accompanying drawings:

(1) Construction of Cone Speaker According to this Invention

Figure 1:
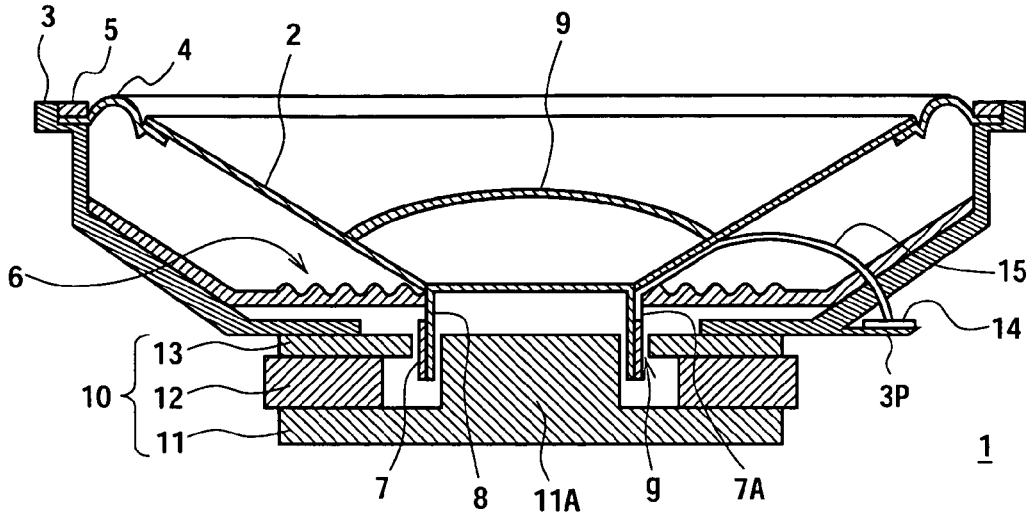
FIG. 1 (RELATED ART)
FIG. 1 is a schematic perspective view showing a construction of a conventional wet speaker.
Figure 2:
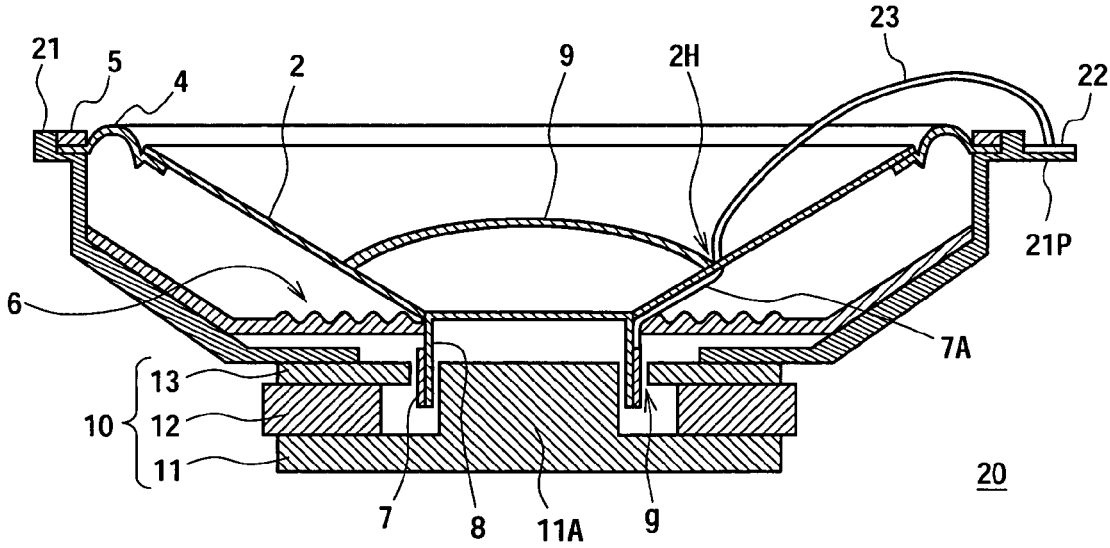
FIG. 2 (RELATED ART)
FIG. 2 is a schematic perspective view showing a construction of a conventional dry speaker.
Figure 3:
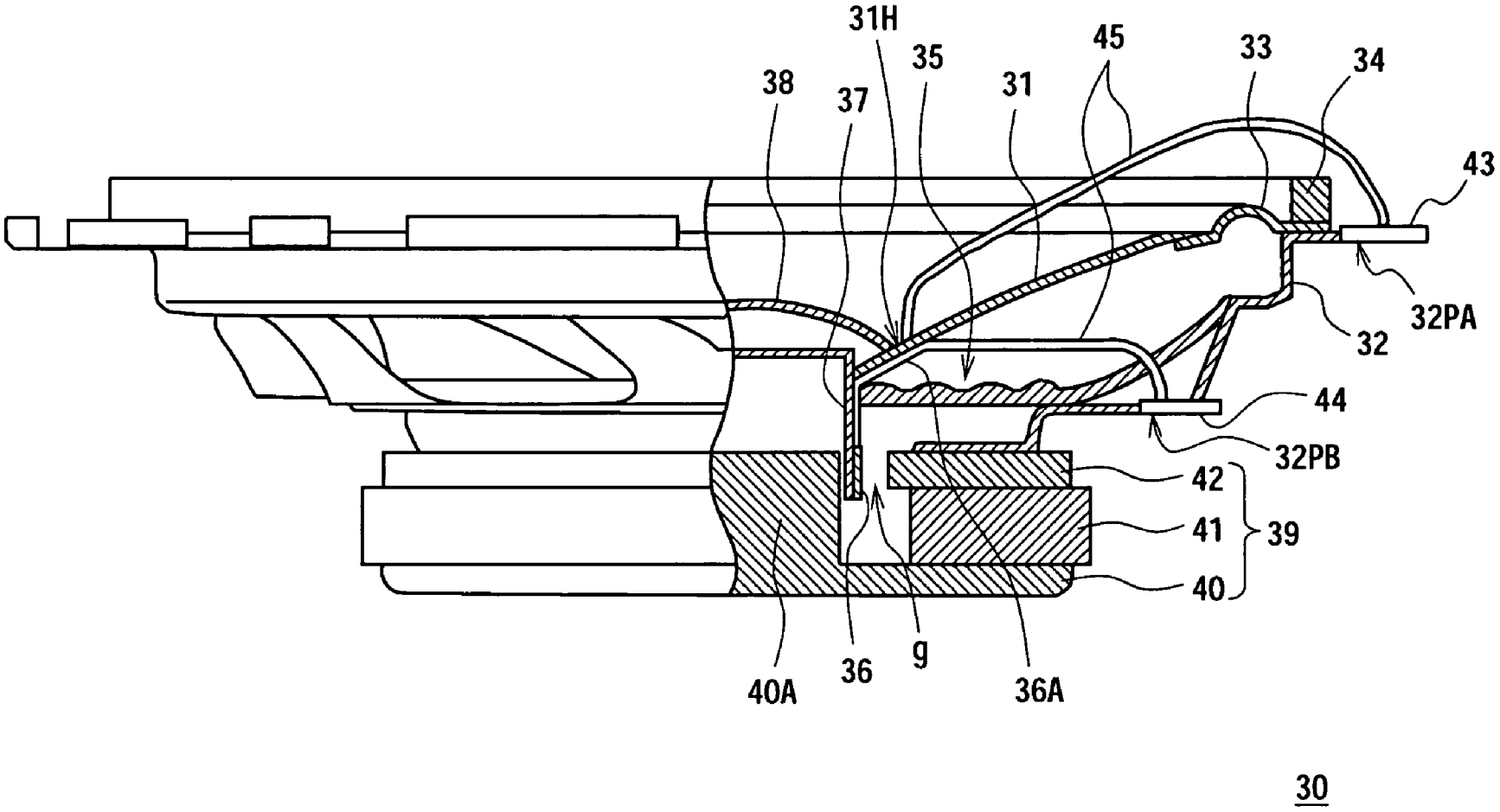
FIG. 3 is a side view showing a partial cross section of a construction of a cone speaker according to this embodiment.

Referring to FIG. 3, reference numeral 30 shows a cone speaker according to this embodiment, which is provided with a conic cone vibratory plate 31 with its end opened. The outer circumference of the cone vibratory plate 31 is supported by an edge 33 formed on a frame 32, via a gasket 34 and the opening of its inner circumference is supported by a damper 35 attached to the frame 32, thereby the cone vibratory plate 31 is movable forwards and backwards to the frame 32.

In addition, the bottom of the opening of the cone vibratory plate 31 is attached to a cylindrical voice coil bobbin 37 having wounded thereon a voice coil 36 comprising a lead line. Above the opening, a hemisphere head cap 38 is attached with its projecting side outwards so as to cover the opening, thereby preventing deformation of the cone vibratory plate 31 in the radial direction and preventing dusts from entering inside.

In addition, to the bottom of the frame 32, a magnetic circuit for vibrating the cone vibratory plate 31 forwards and backwards is fixed. This magnetic circuit 39 is composed of a disk yoke 40 with a column pole piece 40A provided at the center, a toric magnet 41 attached so as to surround the outer circumference of the yoke 40, and a toric plate 42 laminated and fixed on the magnet 41.

When the magnetic circuit 39 is attached to the frame 32 so that the top of the plate 43 is fixed to the bottom of the frame 32, the voice coil bobbin 37 having the voice coil 36 wounded thereon is held in a contactless manner in a magnetic gap g formed between the pole piece 40A and the plate 42.

Thus, in the cone speaker 30, when electromagnetic force is applied to the voice coil 36 according to applied current based on an audio signal externally supplied, the voice coil 36 and the magnet 41 attract or repel each other, thereby generating a sound wave according to the audio signal by vibrating the cone vibratory plate 31 forwards and backwards.

Figure 4A:
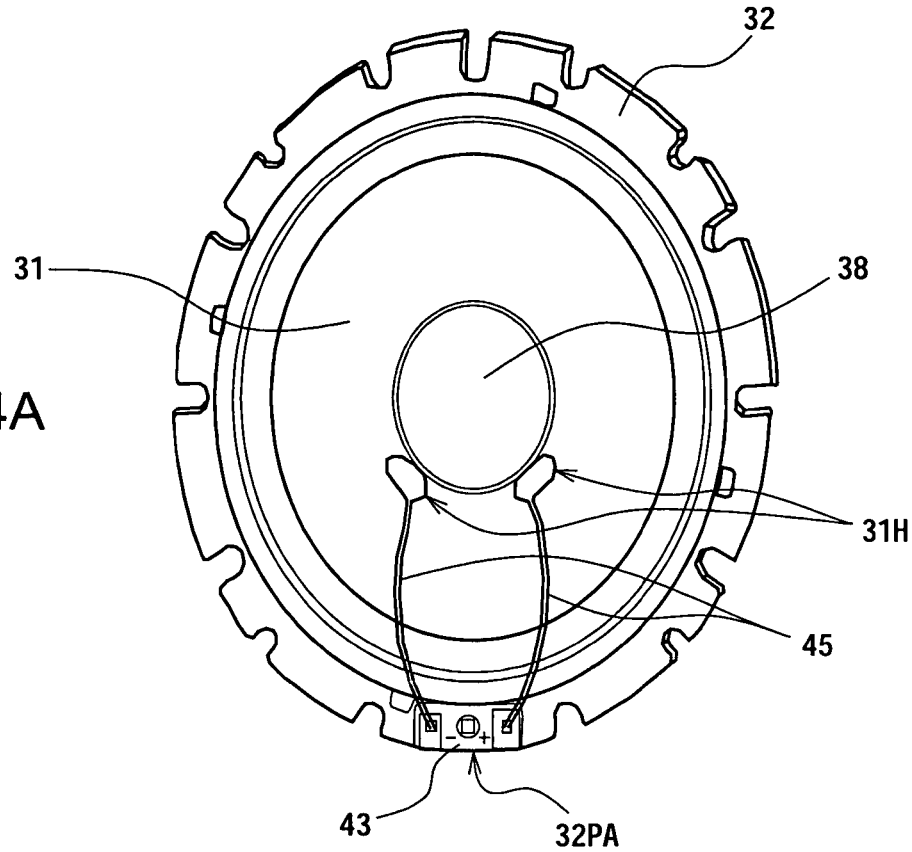
FIGS. 4A and 4B are a schematic front view and back view showing the construction of the cone speaker according to this embodiment.
Figure 4B:
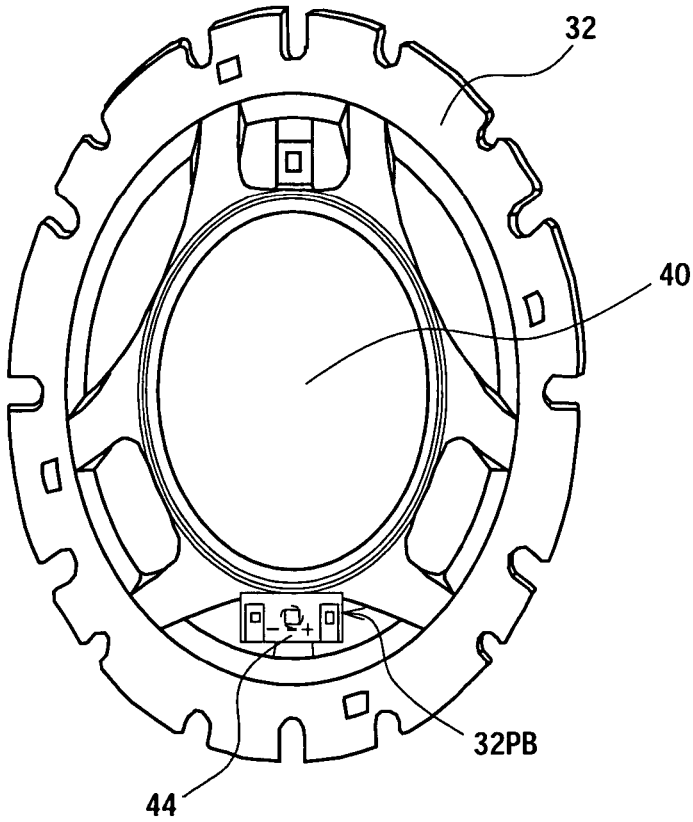

In this cone speaker 30, a dry side connector 43 with a plurality of connecting terminals is provided so as to form part 32PA of the outer circumference on the top of the frame 32 (FIG. 3 and FIG. 4A) and a wet side connector 44 with a plurality of connecting terminals is provided to the outer circumference 32PB at the bottom of the frame 32 (FIG. 3 and FIG. 4B).

Harnesses drawn from the dry side connector 43 are connected so as to be conducted to the wet side connector 44 through a prescribed position 31H of the cone vibratory plate 31. In addition, the harnesses 45 connecting the dry side connector 43 and the wet side connector 44 are connected so as to be conducted to the lead line 36A of the voice coil 36 on the wet side of the cone vibratory plate 31.

(2) State of Attachment of Cone Speaker to Inside of Door

Figure 5:
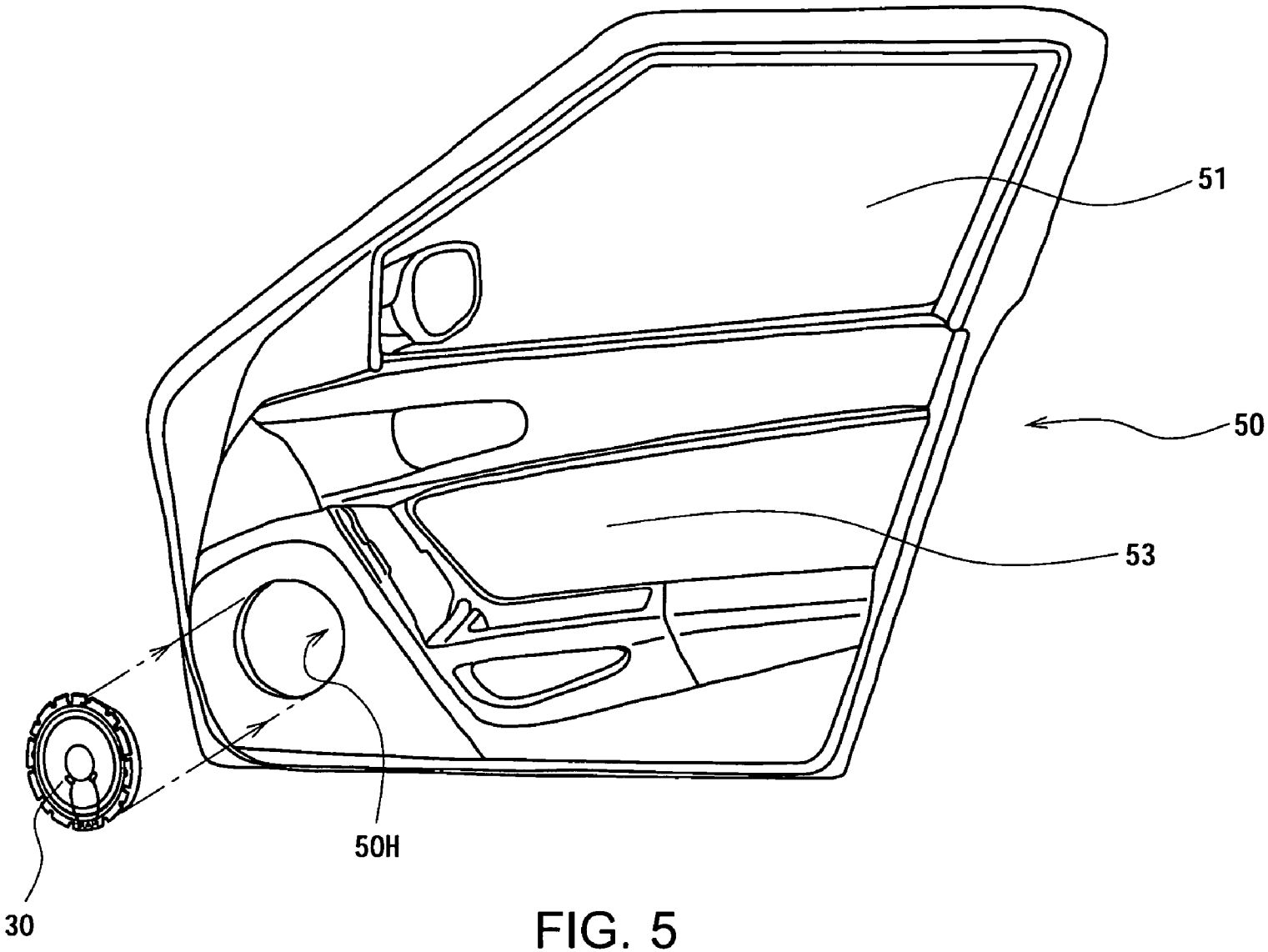
FIGS. 5 and 6 are a schematic perspective view and cross sectional view explaining a state of attachment of the cone speaker to the inside surface of a vehicle door.
Figure 6:
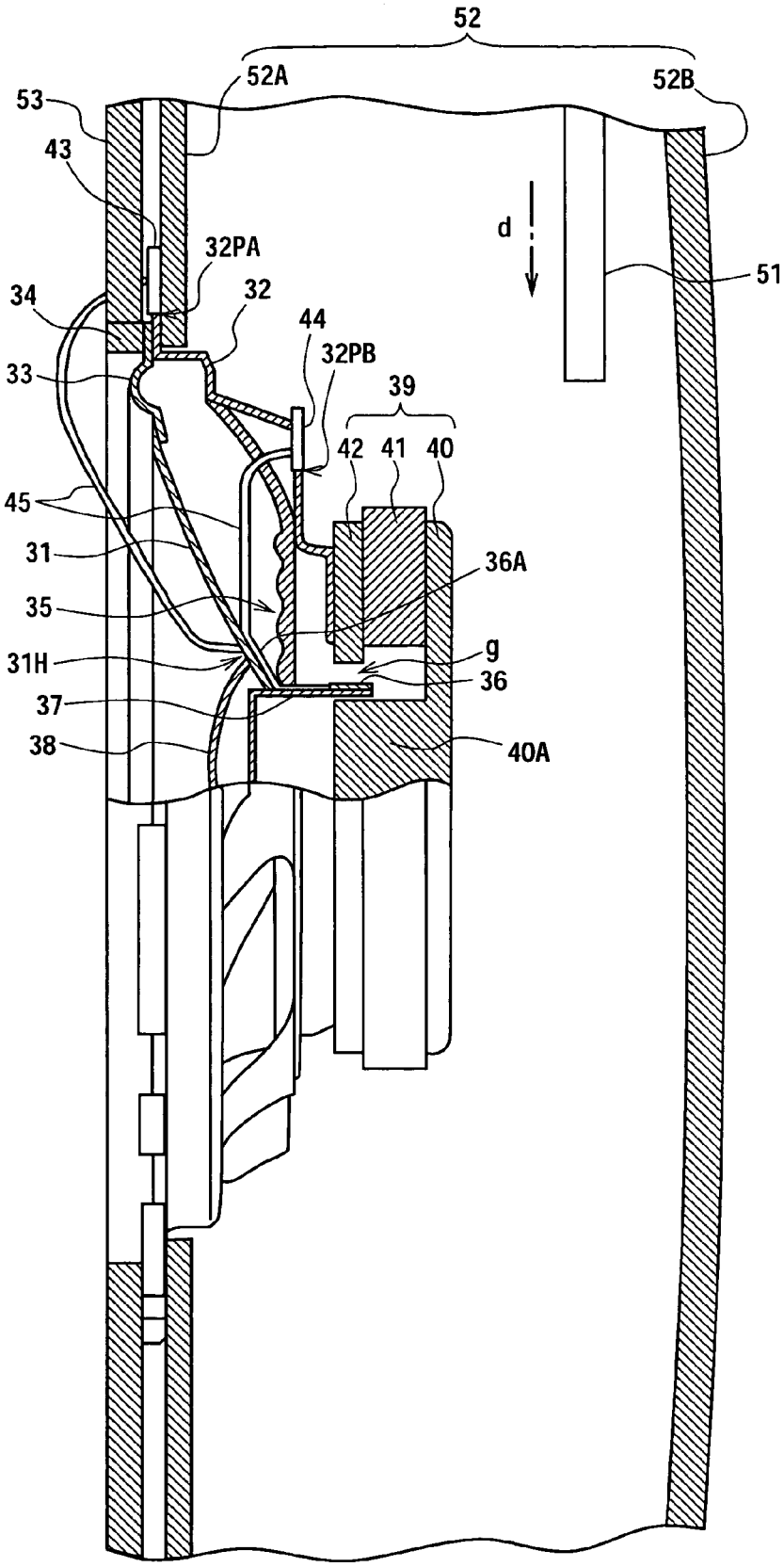

Actually, as shown in FIG. 5, the cone speaker 30 is screwed in an opening 50H for speaker attachment formed at a prescribed position inside a vehicle door 50. Generally, as shown in FIG. 6, the vehicle door 50 has a bag-shaped door panel 52 capable of opening and closing a door window 51, and a door trim 53 in a prescribed shape attached with a prescribed gap to an inner panel 52A forming an inner surface of the door panel 52.

In the inner panel 52 and the door trim 53, openings 52AH and 53H (that is, above-described opening 50H) for a speaker having the almost same shape are formed, and the outer circumference of the frame 32 of the cone speaker 30 inserted from the wet side is fixed to and supported by the opening 52AH of the inner panel 52A.

The door window 51 of the vehicle door 50 slides in a direction shown by an arrow a and in its opposite direction according to the user operation, between the cone speaker 30 fixed to and supported by the inner panel 52A and the outer panel 52B forming the outer surface of the door panel 52 opposite the wet side of the cone speaker 30.

Normally, in the vehicle door 50, there are two ways for containing wires: wires drawn from playback devices (not shown) such as external MD players and tuners are drawn between the inner panel 52A and the outer panel 52B of the door panel 52; and the wires are drawn between the inner panel 52A and the door trim 53. Out of these, in a case where the wires are drawn between the inner panel 52A and the outer panel 52B, they can be connected to the connecting terminals of the dry side connector 43. In a case where the wires are drawn between the inner panel and the door trim, they can be connected to the connecting terminals of the wet side connector 44.

(3) Operation and Effects of this Embodiment

According to the above configuration, in this cone speaker 30, a wire structure which is suitable for the dry side connector 43 or the wet side connector 44 is determined based on the type of the vehicle door 50 to which the speaker 30 is attached, and then wires drawn from external playback devices are connected to the connecting terminals of the selected connector (43 or 44).

At this time, the harnesses 45 drawn from the connector (44 or 43) which is not selected, are all cut off between the connector (44 or 43) and the cone vibratory plate 31. Since unnecessary parts are eliminated, a simple construction can be realized. Specially, when the dry connector 43 is applied, the change of connection of the harnesses 45 from the wet side to the dry side is not necessary, which does not give the user and worker any trouble.

In addition, in a case where a selected connector is the dry side connector 43, this connector 43 forms the part 32PA of the outer circumference of the frame 32. Therefore, when the cone speaker 30 is fixed to and supported by the opening 52AH formed in the inner panel 52A of the door panel 52, contact of the dry side connector 43 to the door trim 53 can be prevented. As a result, the attachment of the speaker 30 is not affected by the shape of the door trim 53, thereby expanding versatility.

According to the above configuration, the cone speaker 30 is provided with the dry side connector 43 and the wet side connector 44 at the top and bottom of the frame 32, and the harnesses 45 drawn from both the dry side connector 43 and the wet side connector 44 are connected so as to be conducted to the lead line 36A of the voice coil 36. Therefore, when the cone speaker 30 is attached to the inside of the vehicle door 50, one connector (43 or 44) can be used as it is, depending on the internal arrangement of the door, thus making it possible to realize a cone speaker 30 with a simple construction capable of keeping the stable attachment, regardless of vehicle types.

(4) Other Embodiments

Note that the above embodiment has described a case where this invention is applied to a cone speaker 30 constructed as shown in FIG. 3 and FIG. 4. This invention, however, is not limited to this and can be widely applied to various speakers, provided that they can give electromagnetic force to a voice coil based on a supplied audio signal and generate a sound wave based on the audio signal by vibrating a vibratory plate fixed to the voice coil.

Further, the above embodiment has described a case where the frame 32 constructed as shown in FIG. 3 and FIG. 4 is applied, which has one end supporting the coil vibratory plate (vibratory plate) 31 and the other end supporting the magnetic circuit (electromagnetic force generation means) 39 for applying electromagnetic force to the voice coil 36. This invention, however, is not limited to this and frames in other various shapes and with other various constructions can be applied, provided that they can be installed on the inside surfaces of the vehicle door 50.

Furthermore, the above embodiment has described a case where the dry side connector (first connector) 43 provided at one end 32PA of the frame 32 and the wet side connector (second connector) 44 provided at the other end 32PB of the frame 32 have plural connecting terminals and are connected so as to be conducted to wires drawn from external playback devices as shown in FIGS. 4A and 4B. This invention, however, is not limited to this and connectors having other various constructions with input terminals for audio signals can be applied.

Furthermore, the above embodiment has described a case where the dry side connector (first connector) 43 forms the part 32PA of the outer circumference on one end of the frame 32. This invention, however, is not limited to this and connectors having other various constructions can be widely applied, provided that they do not contact parts inside the door and can be contained as part of the frame 32 when installed inside the door 50.

For example, in a case of so-called two way speakers, each speaker can be designed so that a crossing part (not shown) on which a tweeter grill is mounted is formed on a frame and a dry side connector (first connector) 43 is provided at the crossing part. At the result, the dry side connector (first connector) 43 can be contained as part of the frame 32.

Furthermore, the above embodiment has described a case where the first wire drawn from the dry side connector (first connector) 43 and connected so as to be conducted to the voice coil 36 via the coil vibratory plate (vibratory plate) 31 and the second wire drawn from the wet side connector (second connector) 44 and connected so as to be conducted to the voice coil 36 are formed by folding the same harness 45 into two. This invention, however, is not limited to this and a single wire or different wires can be applied as the first and second wires and wires with other various constructions can be applied, provided that the dry side connector (first connector) 43 or the wet side connector (second connector) 44 can be selectively connected so as to be conducted to the voice coil 36.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A speaker device for applying electromagnetic force to a voice coil based on a supplied audio signal and generating a sound wave according to the audio signal by vibrating a vibratory plate fixed to the voice coil, comprising:

a frame with one end supporting the vibratory plate and the other end supporting electromagnetic force generation means for applying the electromagnetic force to the voice coil;

a first connector provided at the one end of the frame and having an input terminal for the audio signal;

a first wire drawn from the first connector and connected so as to be conducted to the voice coil through the vibratory plate;

a second connector provided at the other end of the frame and having an input terminal for the audio signal; and a second wire drawn from the second connector and connected so as to be conducted to the voice coil;

wherein only one of the first connector and the second connector is connected to apply electromagnetic force to the voice coil.

2. The speaker device according to claim 1, wherein the first connector forms part of an outer circumference on the one end of the frame.

* * * * *